US008995696B2

(12) United States Patent
Litovsky et al.

(10) Patent No.: US 8,995,696 B2
(45) Date of Patent: Mar. 31, 2015

(54) SPEAKER

(75) Inventors: Roman N. Litovsky, Newton, MA (US); Jason D. Silver, Framingham, MA (US); Darius Mobed, Watertown, MA (US)

(73) Assignee: Bose Corporation, Framingham, MA (US)

( * ) Notice: Subject to any disclaimer, the term of this patent is extended or adjusted under 35 U.S.C. 154(b) by 133 days.

(21) Appl. No.: 13/600,967

(22) Filed: Aug. 31, 2012

(65) Prior Publication Data

US 2014/0064522 A1 Mar. 6, 2014

(51) Int. Cl.

| | |
|---|---|
| ***H04R 25/00*** | (2006.01) |
| ***H04R 3/00*** | (2006.01) |
| ***H04R 1/28*** | (2006.01) |

(52) U.S. Cl.

CPC ..... *H04R 3/00* (2013.01); *H04R 1/2873* (2013.01); *H04R 1/2834* (2013.01); *H04R 2209/026* (2013.01)

USPC ..... 381/182; 381/186; 381/335; 381/342

(58) Field of Classification Search

USPC ..... 381/335, 342, 182, 186

See application file for complete search history.

(56) References Cited

U.S. PATENT DOCUMENTS

| | | | | |
|---|---|---|---|---|
| 1,988,250 | A | | 1/1935 | Olson |
| 3,637,938 | A | * | 1/1972 | Kuhlow et al. ..... 381/308 |
| 4,146,111 | A | | 3/1979 | Mae et al. |
| 4,332,986 | A | | 6/1982 | Butler |
| 4,598,789 | A | | 7/1986 | Ritter |
| 5,150,418 | A | | 9/1992 | Honda et al. |
| 5,749,433 | A | | 5/1998 | Jackson |
| 5,850,460 | A | * | 12/1998 | Tanaka et al. ..... 381/186 |
| 6,044,925 | A | | 4/2000 | Sahyoun |
| 6,356,642 | B1 | | 3/2002 | Nakamura et al. |
| 6,628,792 | B1 | | 9/2003 | Paddock |
| 6,782,112 | B1 | | 8/2004 | Geddes |
| 7,133,533 | B2 | | 11/2006 | Chick et al. |
| 8,189,841 | B2 | | 5/2012 | Litovsky et al. |
| 2004/0131219 | A1 | | 7/2004 | Polk |
| 2004/0218778 | A1 | | 11/2004 | Weisman |
| 2005/0018868 | A1 | | 1/2005 | Chick et al. |
| 2005/0129258 | A1 | | 6/2005 | Fincham |
| 2006/0078136 | A1 | | 4/2006 | Stiles et al. |
| 2006/0291684 | A1 | | 12/2006 | Chick et al. |

(Continued)

FOREIGN PATENT DOCUMENTS

| | | | |
|---|---|---|---|
| CN | 1906970 | A | 1/2007 |
| EP | 0778720 | A1 | 6/1997 |

(Continued)

OTHER PUBLICATIONS

International Search Report and Written Opinion dated Dec. 20, 2013 for International application No. PCT/US2013/057328.

*Primary Examiner* — Davetta W Goins
*Assistant Examiner* — Amir Etesam

(57) ABSTRACT

A speaker includes a housing and four substantially similar electro-acoustic drivers secured inside the housing. The drivers are driven by substantially the same audio signal and are arranged such that the net mechanical vibrational force between the drivers and the housing is substantially zero. Four substantially similar passive radiators are secured inside the housing and driven by acoustic energy from the four drivers. The passive radiators are arranged such that the net mechanical vibrational force between the passive radiators and the housing is substantially zero.

20 Claims, 11 Drawing Sheets

(56) References Cited

U.S. PATENT DOCUMENTS

| | | | | |
|---|---|---|---|---|
| 2007/0201712 | A1 | 8/2007 | Saiki | |
| 2009/0079096 | A1 * | 3/2009 | Tay et al. | 257/787 |

FOREIGN PATENT DOCUMENTS

| | | | |
|---|---|---|---|
| EP | 1791389 | A1 | 5/2007 |
| JP | 50-039123 | A | 4/1975 |
| JP | 56002690 | A | 1/1981 |
| JP | 59207796 | A | 11/1984 |
| JP | 60142593 | A | 7/1985 |
| JP | 60-177798 | A | 9/1985 |
| JP | 62001490 | A | 1/1987 |
| JP | 62-164124 | A | 7/1987 |
| JP | 63-286096 | A | 11/1988 |
| JP | 01-067897 | A | 3/1989 |
| JP | 02-301395 | A | 12/1990 |
| JP | 3-108999 | A | 5/1991 |
| JP | 4117098 | A | 4/1992 |
| JP | 4-192795 | A | 7/1992 |
| JP | 8019083 | A | 1/1996 |
| JP | 08079876 | A | 3/1996 |
| JP | 11205884 | A | 7/1999 |
| JP | 2006528467 | A | 12/2006 |
| WO | 01/62043 | A1 | 8/2001 |
| WO | 2006030760 | A1 | 3/2006 |

* cited by examiner

SPEAKER

BACKGROUND

A speaker with acoustic drivers and passive radiators can be vibrated if the drivers and passive radiators are not arranged so that their mechanical vibrations cancel out. This speaker vibration can cause the speaker to "walk" or move along a surface on which the speaker has been placed. In addition, a speaker with a multiplicity of drivers and a multiplicity of passive radiators can end up being relatively large in all dimensions.

SUMMARY

In one aspect, a speaker includes a housing and four substantially similar electro-acoustic drivers secured inside the housing. The drivers are driven by substantially the same audio signal and are arranged such that the net mechanical vibrational force between the drivers and the housing is substantially zero. Four substantially similar passive radiators are secured inside the housing and driven by acoustic energy from the four drivers. The passive radiators are arranged such that the net mechanical vibrational force between the passive radiators and the housing is substantially zero.

Embodiments may include one or more of the following features. The intended directions of travel of the four drivers and the four passive radiators are substantially parallel with each other. The intended directions of travel of the four drivers and the four passive radiators are substantially parallel with a shortest dimension of the housing. A longest dimension of each of the drivers and each of the passive radiators lies substantially in a common plane. One of the drivers has a diaphragm with a first surface and a second surface. The diaphragm is vibrated during operation of the driver such that the first surface creates acoustic energy in a first acoustic volume inside the housing. The acoustic energy exits the speaker through an opening in the housing located along a first portion of the housing. One of the passive radiators has a first surface and a second surface. The diaphragm is vibrated during operation of the driver such that the second surface of the diaphragm creates acoustic energy in a second acoustic volume inside the housing. The acoustic energy in the second acoustic volume impinges on the first surface of the passive radiator which causes the passive radiator to vibrate. A second surface of the passive radiator thereby creates acoustic energy which exits the speaker through a second opening in the housing located along a second portion of the housing which is oriented at substantially a right angle to the first portion of the housing. The four drivers are arranged substantially side-by-side with each other in a substantially straight line. The four passive radiators are arranged substantially side-by-side with each other in a substantially straight line. Each driver is mounted on a respective passive radiator.

In another aspect, a speaker includes a housing and an electro-acoustic driver secured inside the housing having a diaphragm with a first surface and a second surface. The diaphragm is vibrated during operation of the driver such that the first surface creates acoustic energy in a first acoustic volume inside the housing. The acoustic energy exits the speaker through an opening in the housing located along a first portion of the housing. A passive radiator is secured inside the housing and hays a first surface and a second surface. The diaphragm is vibrated during operation of the driver such that the second surface of the diaphragm creates acoustic energy in a second acoustic volume inside the housing. The acoustic energy in the second acoustic volume impinges on the first surface of the passive radiator which causes the passive radiator to vibrate. A second surface of the passive radiator thereby creates acoustic energy which exits the speaker through a second opening in the housing located along a second portion of the housing which is oriented at substantially a right angle to the first portion of the housing. Embodiments may include any of the above features and/or the following. The intended directions of travel of the driver and the passive radiator are substantially parallel with each other. The intended directions of travel of the driver and the passive radiator are substantially parallel with a shortest dimension of the housing. A longest dimension of the driver and the passive radiator lies substantially in a common plane.

In yet another aspect, a speaker includes a housing having a first internal surface and a second internal surface that is substantially parallel with the first surface. The housing defines at least a portion of a common acoustic volume inside the housing. First and second electro-acoustic drivers secured inside the housing each have a diaphragm with a first surface and a second surface. The first surface of the first driver faces the first internal surface of the housing. The second surface of the first driver faces the second internal surface of the housing and the common acoustic volume. The first surface of the second driver faces the second internal surface of the housing. The second surface of the second driver faces the first internal surface of the housing and the common acoustic volume.

Embodiments may include any of the above features and/or the following. The speaker includes first and second passive radiators secured inside the housing that each have a first surface and a second surface. The first surface of the first passive radiator faces the first internal surface of the housing. The second surface of the first passive radiator faces the second internal surface of the housing and the common acoustic volume. The first surface of the second passive radiator faces the second internal surface of the housing. The second surface of the second passive radiator faces the first internal surface of the housing and the common acoustic volume. In still another aspect, a speaker includes a housing having a first internal surface and a second internal surface that is substantially parallel with the first surface. The housing defines at least a portion of a common acoustic volume inside the housing. First and second passive radiators are secured inside the housing, and each have a first surface and a second surface. The first surface of the first passive radiator faces the first internal surface of the housing. The second surface of the first passive radiator faces the second internal surface of the housing and the common acoustic volume. The first surface of the second passive radiator faces the second internal surface of the housing. The second surface of the second passive radiator faces the first internal surface of the housing and the common acoustic volume.

Embodiments may include any of the above features and/or the following. The speaker further includes an electro-acoustic driver secured inside the housing and having a diaphragm with a first surface and a second surface. The diaphragm is vibrated during operation of the driver such that the first surface creates acoustic energy in an additional acoustic volume inside the housing. The acoustic energy exits the speaker through an opening in the housing located along a portion of the housing.

In still another aspect, a speaker includes a housing and three passive radiators supported by the housing for movement. One of the passive radiators has a moving portion which weighs substantially the same as the combined weights of the moving portions of the other two passive radiators.

Embodiments may include any of the above features and/or the following. A surface area of the moving portion of the one of the passive radiators is substantially the same as the combined surface areas of the moving portions of the other two passive radiators. The passive radiators do not overlap each other in a direction parallel to a direction of motion of a moving portion of the passive radiators.

DETAILED DESCRIPTION

The description below discloses a speaker that includes four electro-acoustic drivers and four passive radiators. The drivers and passive radiators are arranged so that (a) the mechanical vibrations from all of the drivers and passive radiators substantially cancel out, and (b) a height of the speaker is substantially less than a width and a length of the speaker. As such, the speaker can be secured to the back of a flat panel video display to provide enhanced acoustic performance without appreciably increasing the depth of the display.

Figure 1:
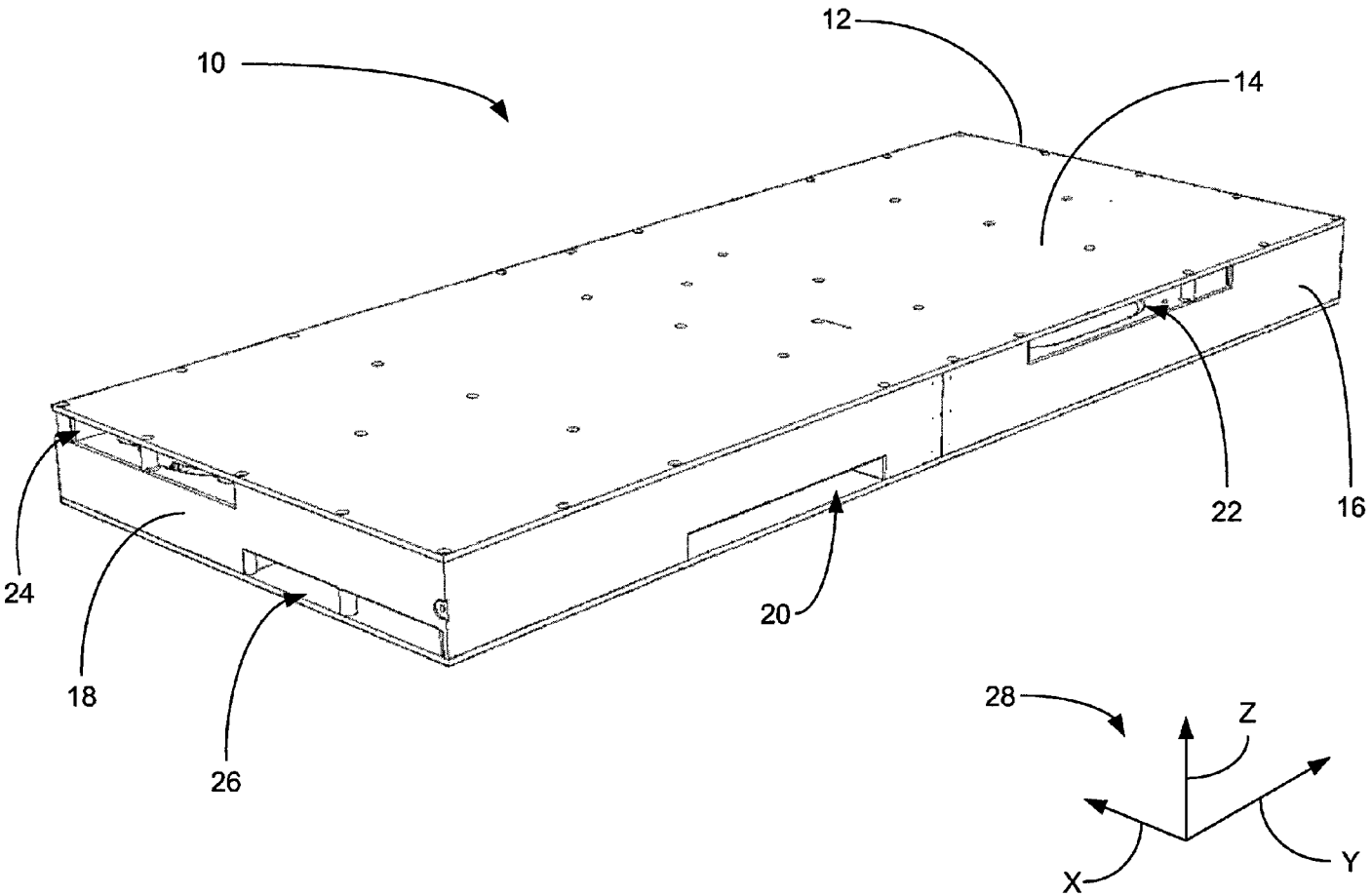
FIG. 1 is a perspective view of a speaker as seen from the top, front and left sides.

With reference to FIG. 1, a speaker 10 includes a housing 12 with a top portion 14, a front portion 16 and a left portion 18. The front housing portion 16 includes two openings 20 and 22 which allow acoustic energy from inside the speaker 10 to propagate to an environment external to the speaker. The left housing portion 16 includes two openings 24 and 26 which allow acoustic energy from inside the speaker 10 to propagate to the environment. The size of the housing 12 in the Z dimension of the coordinate axes 28 is substantially smaller than the size of the housing in the X and Y dimensions.

Figure 2:
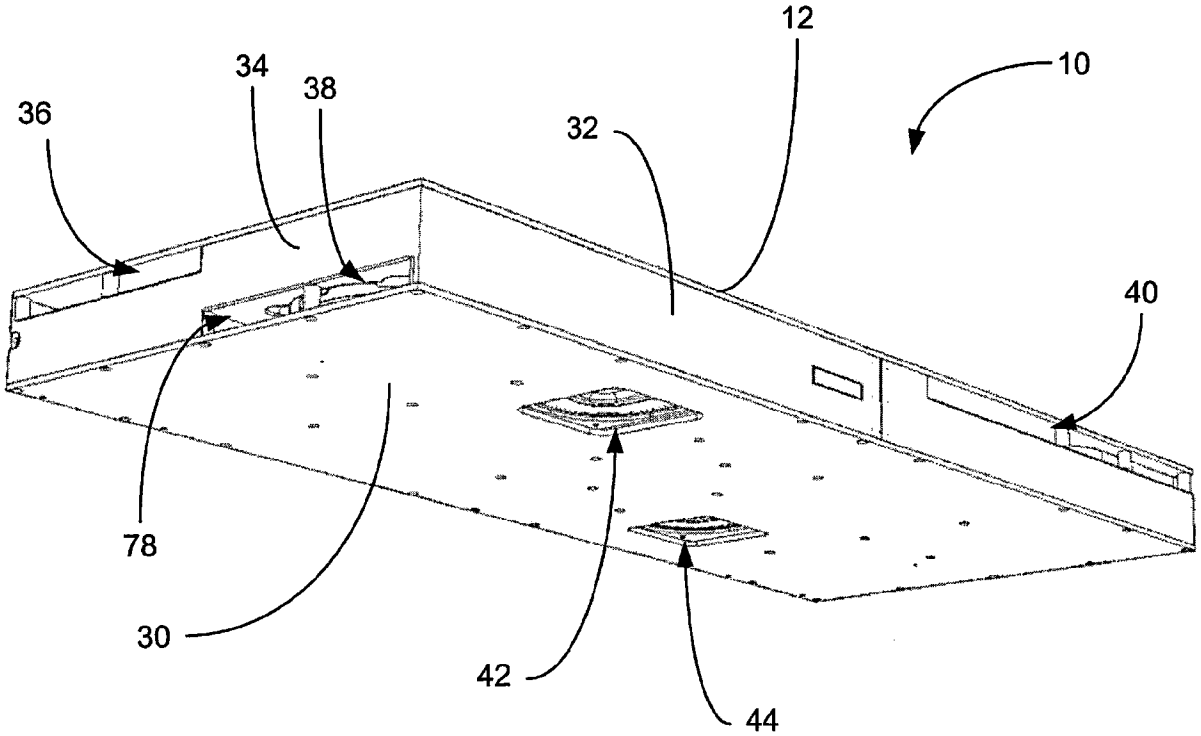
FIG. 2 is a perspective view of the speaker of FIG. 1 as seen from the bottom, rear and right sides.

Turning to FIG. 2, the housing 12 of the speaker 10 has a bottom portion 30, a rear portion 32 and a right portion 34. The right housing portion 34 includes two openings 36 and 38 which allow acoustic energy from inside the speaker 10 to propagate to the environment. The rear housing portion 32 includes an opening 40 which allows acoustic energy from inside the speaker 10 to propagate to the environment. The bottom housing portion 34 includes two openings 42 and 44 which allow acoustic energy from inside the speaker 10 to propagate to the environment. Four feet (not shown) are preferably placed on the housing portion 30 to stand off the speaker 10 from a horizontal surface on which the speaker is placed. This arrangement allows acoustic energy emanating from openings 42 and 44 to more effectively reach the environment in which the speaker 10 resides.

Figure 3:
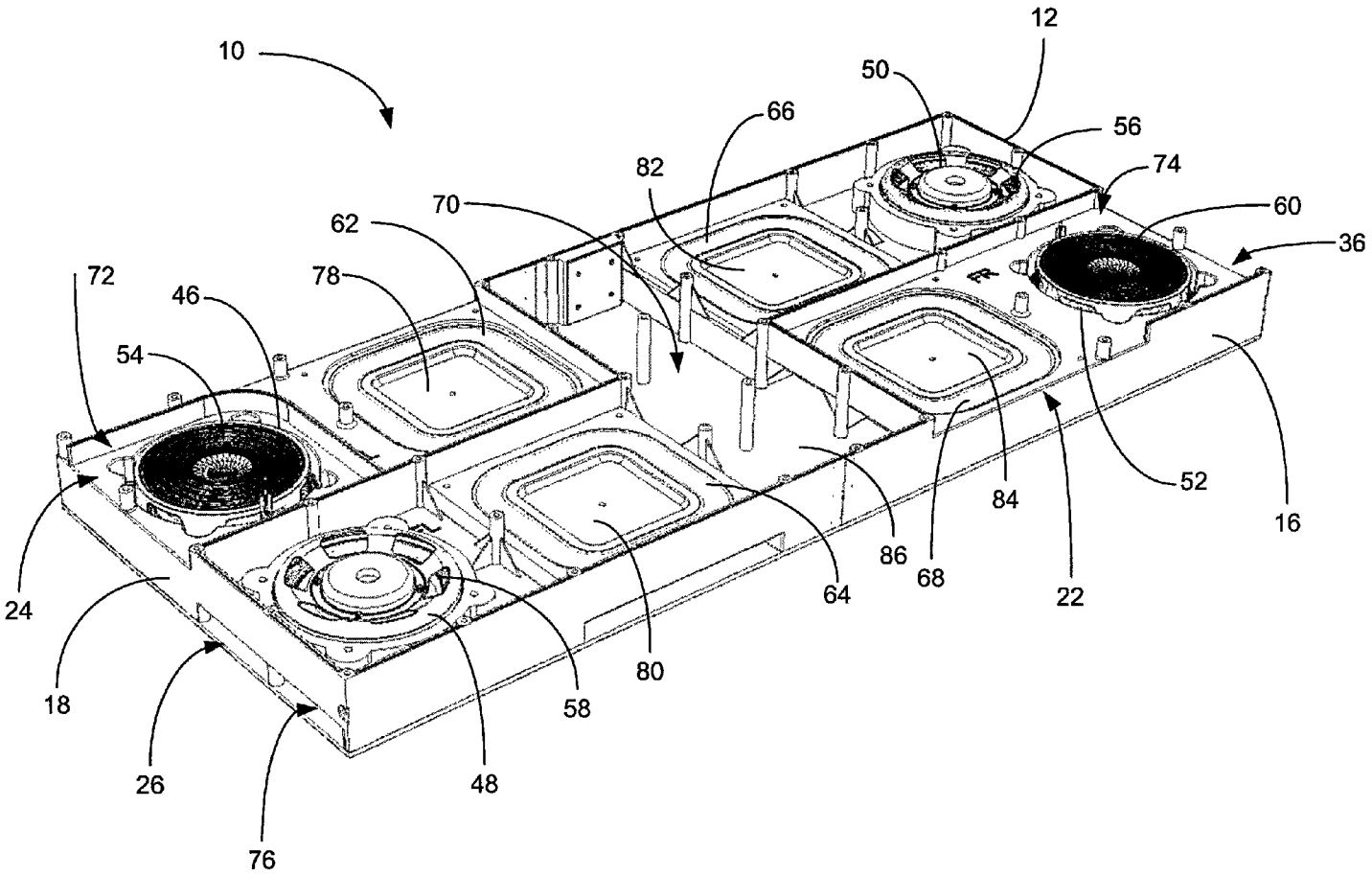
FIG. 3 is similar to FIG. 1 except that a top portion of a speaker housing has been removed to facilitate viewing of the inside of the speaker.

Referring now to FIG. 3, the speaker 10 includes four substantially similar electro-acoustic drivers 46, 48, 50 and 52 which are secured inside the housing 12 and driven by substantially the same audio signal. Electrical power cables and audio signal cables are not shown in the drawings in order to not over-clutter the drawings. Other elements such as a power supply, amplifier and digital signal processor are likewise not shown, and may be included in an audio device (e.g. an amplifier) separate from the speaker 10. The drivers 46 and 52 are inverted relative to the drivers 48 and 50. When diaphragms 54 and 60 of the drivers 46 and 52 are moving in one direction, diaphragms 56 and 58 of the drivers 48 and 50 will be moving in the opposite direction. This arrangement of the drivers results in substantially zero net mechanical vibrational energy being induced by the drivers on the housing 12.

The speaker 10 also includes four substantially similar passive radiators 62, 64, 66 and 68 which are secured inside the housing 12. Each of these passive radiators preferably uses a surround described in U.S. patent application Ser. No. 12/977,484 (publication 20120160598) which is incorporated herein by reference. This type of surround provides a more symmetrical force and motion in the intended direction of travel of the passive radiator, and reduces undesired rocking motion of the radiator. There is a common acoustic volume 70 inside the housing 12 that is defined at least in part by the housing which is sealed from the environment external to the housing 12. As viewed in FIG. 3, the volume 70 extends above the radiator 66, driver 50, radiator 64 and driver 48. The volume 70 also extends below the radiator 68, driver 52, radiator 62 and driver 46. With this arrangement, when the diaphragms 54 and 60 move down as viewed in FIG. 3 and the diaphragms 56 and 58 move up, this will cause a pressure increase in the volume 70. This pressure increase will cause the radiators 64 and 66 to move down at the same time the radiators 62 and 68 move up (the four radiators are driven by acoustic energy from the four drivers). When the diaphragms 54 and 60 move up and the diaphragms 56 and 58 move down, this will cause a pressure decrease in the volume 70. This pressure decrease will cause the radiators 64 and 66 to move up at the same time the radiators 62 and 68 move down (the four radiators are driven by acoustic energy from the four drivers). This arrangement of the passive radiators results in a substantially zero net mechanical vibrational force between the passive radiators and the housing.

In this example, the intended directions of travel of the four drivers 46, 48, 52 and 54 and the four passive radiators 62, 64, 66 and 68 are substantially parallel with each other and the shortest dimension of the housing 12 along the Z axis (FIG. 1). In addition, as shown in FIG. 3, a longest dimension of each of the drivers 46, 48, 50 and 52, and each of the passive radiators 62, 64, 66 and 68 lies substantially in a common plane which is substantially parallel to the bottom portion 30 of the housing 12. However, it is not necessary that the passive radiators all lie in the same plane. The radiators may lie in two or more parallel planes and/or may be skewed relative to each other. What matters is that the net mechanical vibration from the four radiators on the housing 12 cancels out and is substantially zero. The same thing goes for the four drivers. This arrangement of drivers and passive radiators allows for a relatively thin speaker (e.g. in the Z direction) because two passive radiators do not need to be stacked on top of each other (e.g. in the Z direction). Instead, the passive radiators are substantially side-by-side. In this example the speaker 10 can be tuned to about 55 hz.

The driver diaphragms 54, 56, 58 and 60 each have a surface that is visible in FIG. 3 and a surface on the opposite side of the diaphragm that is not visible. Diaphragm 54 is vibrated during operation of driver 46 such that the diaphragm surface visible in FIG. 3 creates acoustic energy in an acoustic volume 72 inside the housing 12. This acoustic energy exits the speaker 10 through the opening 24 in the housing 12. Diaphragm 60 is vibrated during operation of driver 46 such that the diaphragm surface visible in FIG. 3 creates acoustic energy in an acoustic volume 74 inside the housing 12. This acoustic energy exits the speaker 10 through the openings 36 and 22 in the housing 12. Diaphragm 58 is vibrated during operation of driver 46 such that the diaphragm surface which is not visible in FIG. 3 creates acoustic energy in an acoustic volume 76 inside the housing 12. This acoustic energy exits the speaker 10 through the opening 26 in the housing 12. Diaphragm 56 is vibrated during operation of driver 50 such that the diaphragm surface which is not visible in FIG. 3 creates acoustic energy in an acoustic volume 78 (FIG. 2) inside the housing 12. This acoustic energy exits the speaker 10 through the opening 38 in the housing 12.

Each of the passive radiators 62, 64, 66, and 68 has a respective surface 78, 80, 82 and 84 that is visible in FIG. 3, and a second surface on the respective opposite sides of the radiators that is not visible in FIG. 3. As discussed above, the driver diaphragms 54, 56, 58 and 60 are moved/vibrated during operation of the drivers 46, 48, 50 and 52 such that a surface of each diaphragm creates acoustic energy (pressure increases and decreases) in the acoustic volume 70 inside the housing 12. This acoustic energy in the acoustic volume 70 impinges on (a) the surfaces 80 and 82 of the passive radiators 64 and 66, and (b) the surfaces of radiators 62 and 68 which are not visible in FIG. 3. As a result, the passive radiators 62, 64, 66 and 68 move/vibrate. This causes (a) the surfaces 78 and 84 of the passive radiators 62 and 68, and (b) the surfaces of radiators 64 and 66 which are not visible in FIG. 3 to create acoustic energy.

Acoustic energy from surface 78 exits the speaker 10 through the opening 40 (FIG. 2) in the housing 12 located along portion 32 of the housing which is oriented at substantially a right angle to the portion 18 of the housing. Acoustic energy from surface 84 exits the speaker 10 through the openings 22 and 36 (FIGS. 1 and 2) in the housing 12. Acoustic energy from the surface of the radiator 64 which is not visible in FIG. 3 exits the speaker 10 through the openings 20 and 44 (FIGS. 1 and 2) in the housing 12. Acoustic energy from the surface of the radiator 66 which is not visible in FIG. 3 exits the speaker 10 through the opening 42 (FIG. 2) in the housing 12.

An internal surface 86 of the housing portion 30 (FIG. 2) and an internal surface (not shown) of the housing portion 14 (FIG. 1) are substantially parallel with each other. The surfaces of the diaphragms 54 and 60 that are visible in FIG. 3 face the internal surface of housing portion 14. The surfaces of the diaphragms 54 and 60 that are not visible in FIG. 3 face the internal surface 86 of the housing portion 30 and the common acoustic volume 70. The surfaces of the diaphragms 56 and 58 that are visible in FIG. 3 face the internal surface of housing portion 14 and the common acoustic volume 70. The surfaces of the diaphragms 56 and 58 that are not visible in FIG. 3 face the internal surface 86 of the housing portion 30.

The surfaces 78 and 84 of the passive radiators 62 and 68 that are visible in FIG. 3 face the internal surface of housing portion 14. The surfaces of the passive radiators 62 and 68 that are not visible in FIG. 3 face the internal surface 86 of the housing portion 30 and the common acoustic volume 70. The surfaces 80 and 82 of the passive radiators 64 and 66 that are visible in FIG. 3 face the internal surface of housing portion 14 and the common acoustic volume 70. The surfaces of the passive radiators 64 and 66 that are not visible in FIG. 3 face the openings 44 and 42 in the housing portion 30.

Figure 4:
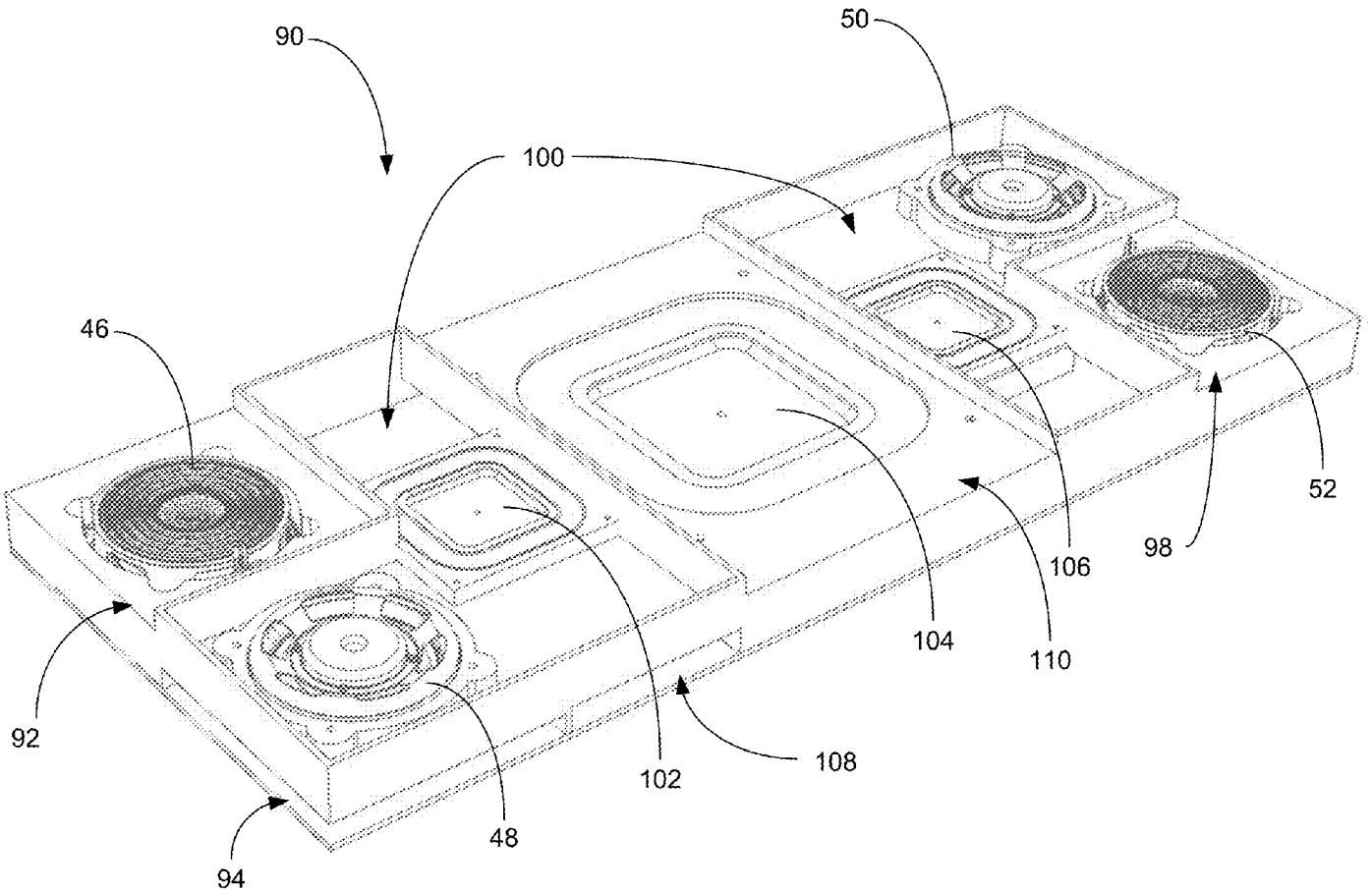
FIG. 4 is another example of a speaker as seen from the top, front and left sides.
Figure 5:
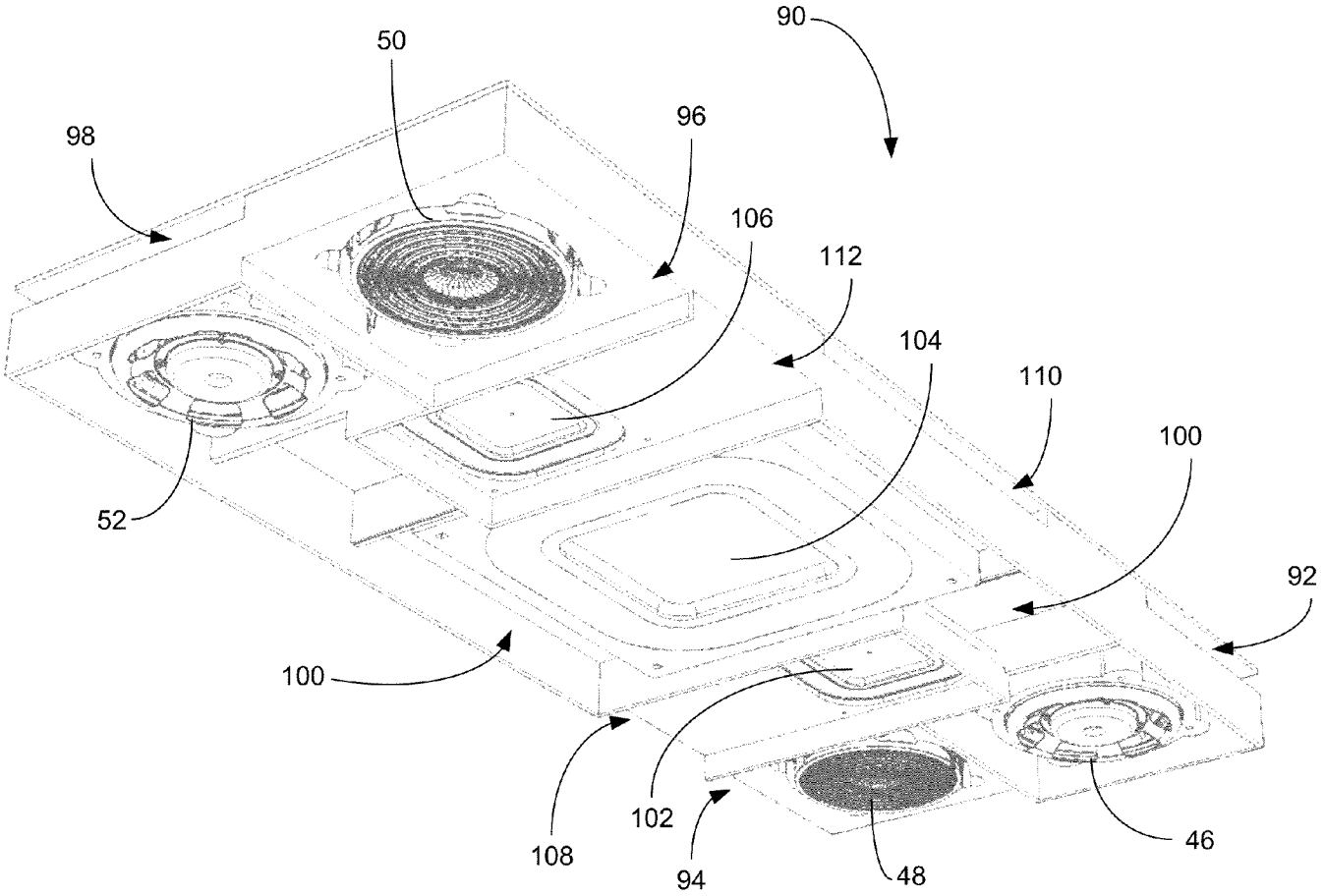
FIG. 5 is a view of the speaker of FIG. 4 as seen from the bottom, rear and right sides.

FIGS. 4 and 5 disclose another example of a speaker 90. The four drivers 46, 48, 50 and 52 have the same structure and operate in the same manner as the four drivers described above in FIG. 3. The drivers 46, 48, 50 and 52 each radiate acoustic energy which exits the speaker through respective openings 92, 94, 96 and 98 in the housing in a manner similar to that described above with reference to FIG. 3. The drivers 46, 48, 50 and 52 each also radiate acoustic energy into a common acoustic volume 100 which functions in a similar way to the acoustic volume 76 described above.

The speaker 90 has three passive radiators 102, 104 and 106 as compared with the speaker 10 described above which has four substantially identical passive radiators. The radiators 102, 104 and 106 radiate acoustic energy which exits the speaker through respective openings 108, 110 and 112 in the housing in a manner similar to that described above with reference to FIG. 3. The radiators 102, 104 and 106 each also have a surface exposed to the common acoustic volume 100 in a manner similar to that described above with reference to FIG. 3. The moving portion of radiator 104 weighs twice as much and has twice the surface area as the combined moving portions of the radiators 102 and 106. As such, the radiators 102, 104 and 106 are force balanced when the speaker 90 is operating resulting in substantially zero net force being imparted to the speaker 90. As in FIG. 3, the passive radiators 102, 104 and 106 do not overlap each other in a direction parallel to a direction of motion of a moving portion of the passive radiators.

Figure 6:
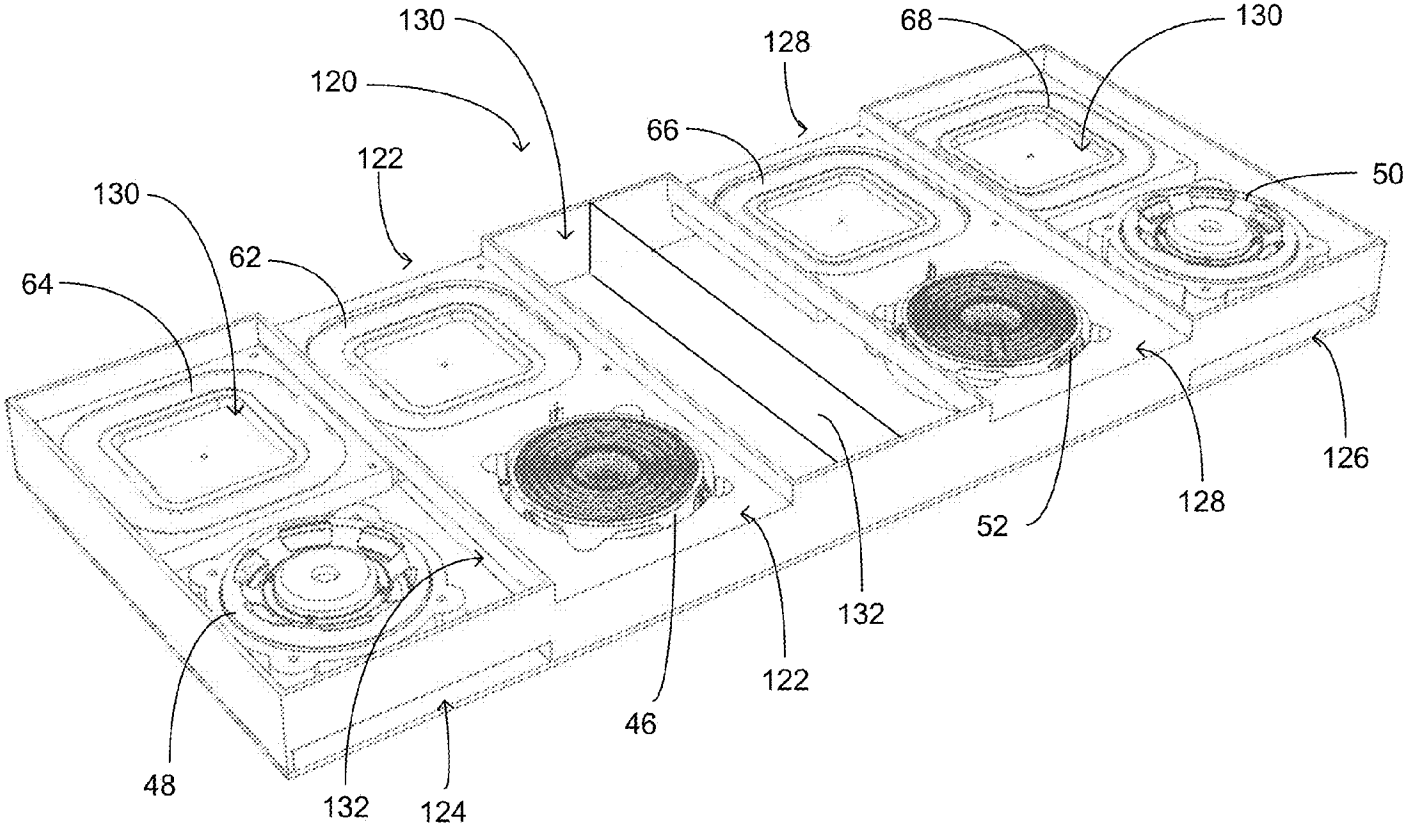
FIG. 6 is yet another example of a speaker as seen from the top, front and left sides.
Figure 7:
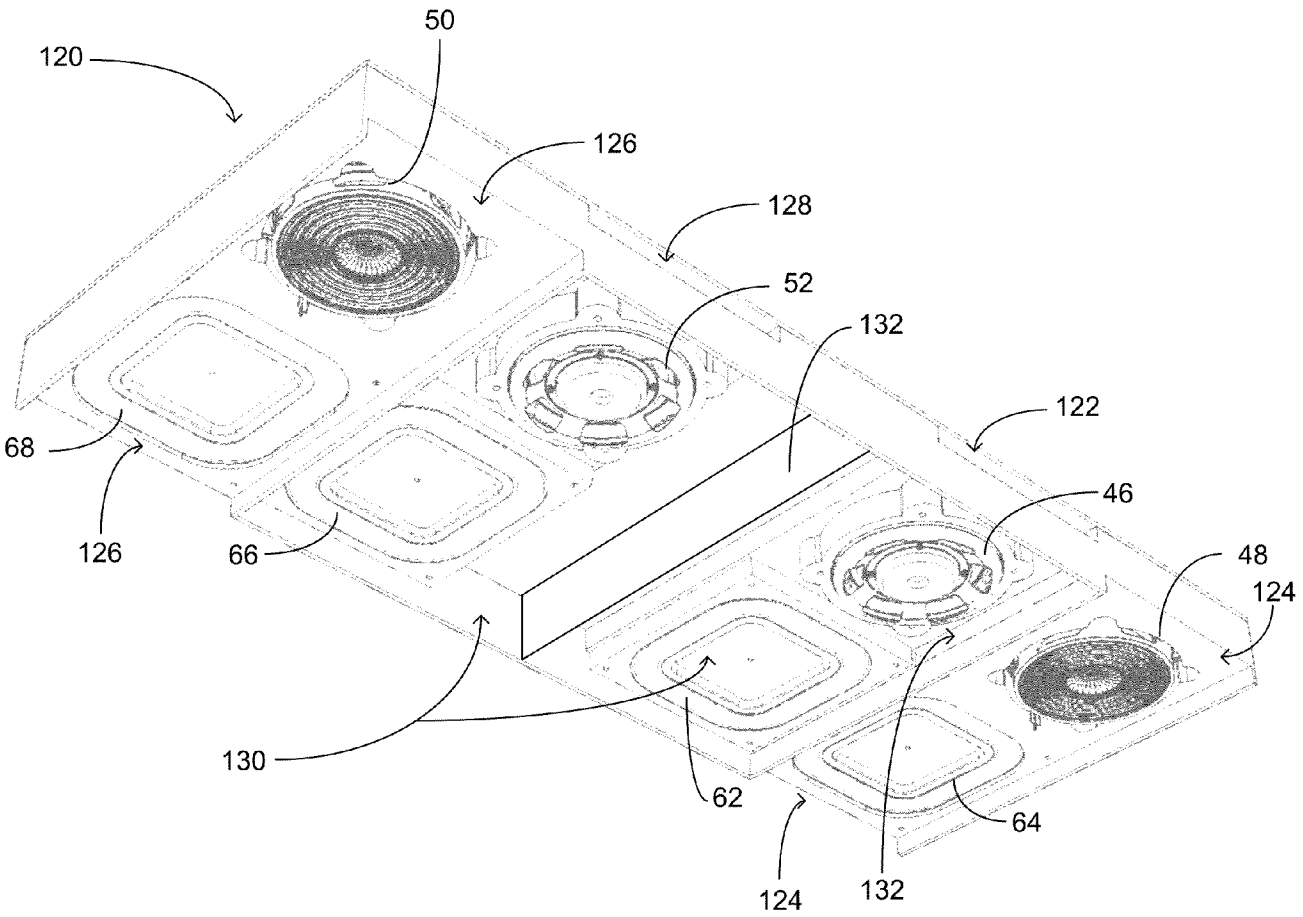
FIG. 7 is a view of the speaker of FIG. 6 as seen from the bottom, rear and right sides.

FIGS. 6 and 7 disclose another example of a speaker 120. The four drivers 46, 48, 50 and 52 have substantially the same structure and operate in substantially the same manner as the four drivers described above in FIG. 3. The driver 48 is in substantially the same location in FIG. 6 as it was in FIG. 3. However, when comparing FIG. 6 to FIG. 3, the driver 46 has swapped places with the radiator 64, the driver 52 has been moved to the location of the radiator 68, the radiator 68 has been moved to the location of the driver 50, and the driver 50 has been moved to the location of the driver 52. The radiators 62 and 66 are in similar positions to those shown in FIG. 3. The drivers 46, 48, 50 and 52 are side-by-side in a substantially straight line. The radiators 62, 64, 66 and 69 are also side-by-side in a substantially straight line.

The driver/radiator pairs 46/62, 48/64, 50/68 and 52/66 each radiate acoustic energy which exits the speaker through respective openings 122, 124, 126 and 128 in the housing in a manner similar to that described above with reference to FIG. 3. The drivers 46, 48, 50 and 52 each also radiate acoustic energy into a common acoustic volume 130 which functions in a similar way to the acoustic volume 76 described above. The driver 48 radiates acoustic energy into a main portion of the common volume 130 via a slot 132. There is a similarly arranged slot through which the driver 50 radiates acoustic energy into the main portion of the common volume 130, but this slot is not visible in FIGS. 6 and 7. The radiators 62, 64, 66 and 68 each also have a surface exposed to the common acoustic volume 130 in a manner similar to that described above with reference to FIG. 3. As in FIG. 3, the passive radiators 62, 64, 66 and 68 do not overlap each other in a direction parallel to a direction of motion of a moving portion of the passive radiators. An optional wall 132 may be provided to divide the common acoustic volume 130 into two portions having substantially equal volume. This wall substantially acoustically isolates the driver/radiator pairs 46/62 and 48/64 from the pairs 50/68 and 52/66.

Figure 8:
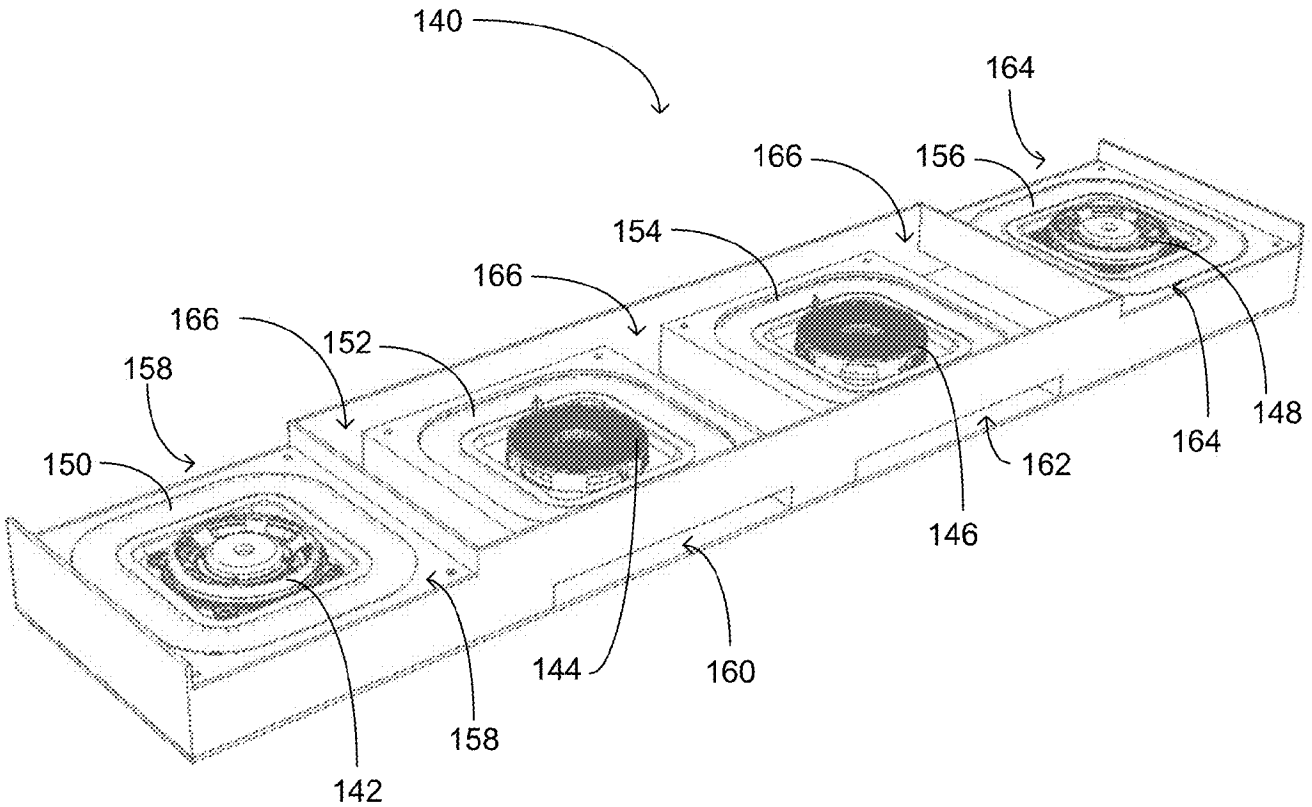
FIG. 8 is a further example of a speaker as seen from the top, front and left sides.
Figure 9:
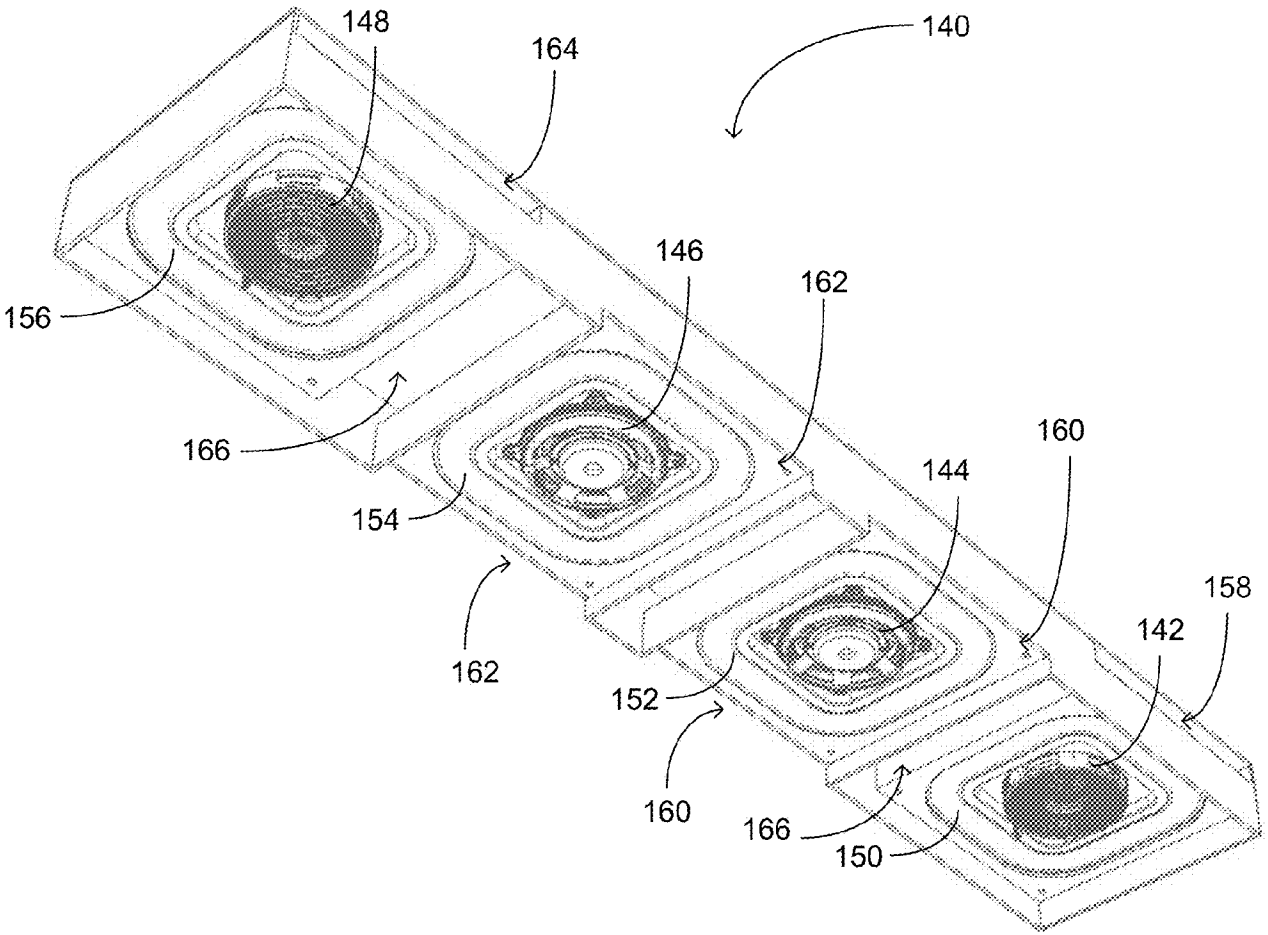
FIG. 9 is a view of the speaker of FIG. 8 as seen from the bottom, rear and right sides.

FIGS. 8 and 9 disclose another example of a speaker 120. Four drivers 142, 144, 146 and 148 are respectively mounted on four passive radiators 150, 152, 154 and 156. This arrangement of a driver/passive radiator pair is disclosed in U.S. Pat. No. 8,189,841 which is incorporated herein by reference. The driver/passive radiator pairs 142/150, 144/152, 146/154 and 148/156 are arranged side-by-side in a substantially straight line. The driver/radiator pairs 142/150, 144/152, 146/154 and 148/156 each radiate acoustic energy which exits the speaker through respective openings 158, 160, 162 and 164 in the housing in a manner similar to that described above with reference to FIG. 3. The driver/radiator pairs 142/150, 144/152, 146/154 and 148/156 each also radiate acoustic energy into a common acoustic volume 166 which functions in a similar way to the acoustic volume 76 described above. As such, the driver/radiator pairs 142/150, 144/152, 146/154 and 148/156 each have a surface exposed to the common acoustic volume 166 in a manner similar to that described above with reference to FIG. 3. As in FIG. 3, the passive radiators 62, 64, 66 and 68 do not overlap each other in a direction parallel to a direction of motion of a moving portion of the passive radiators. The driver/radiator pairs 142/150, 144/152, 146/154 and 148/156 are side-by-side in a substantially straight line.

Figure 10:
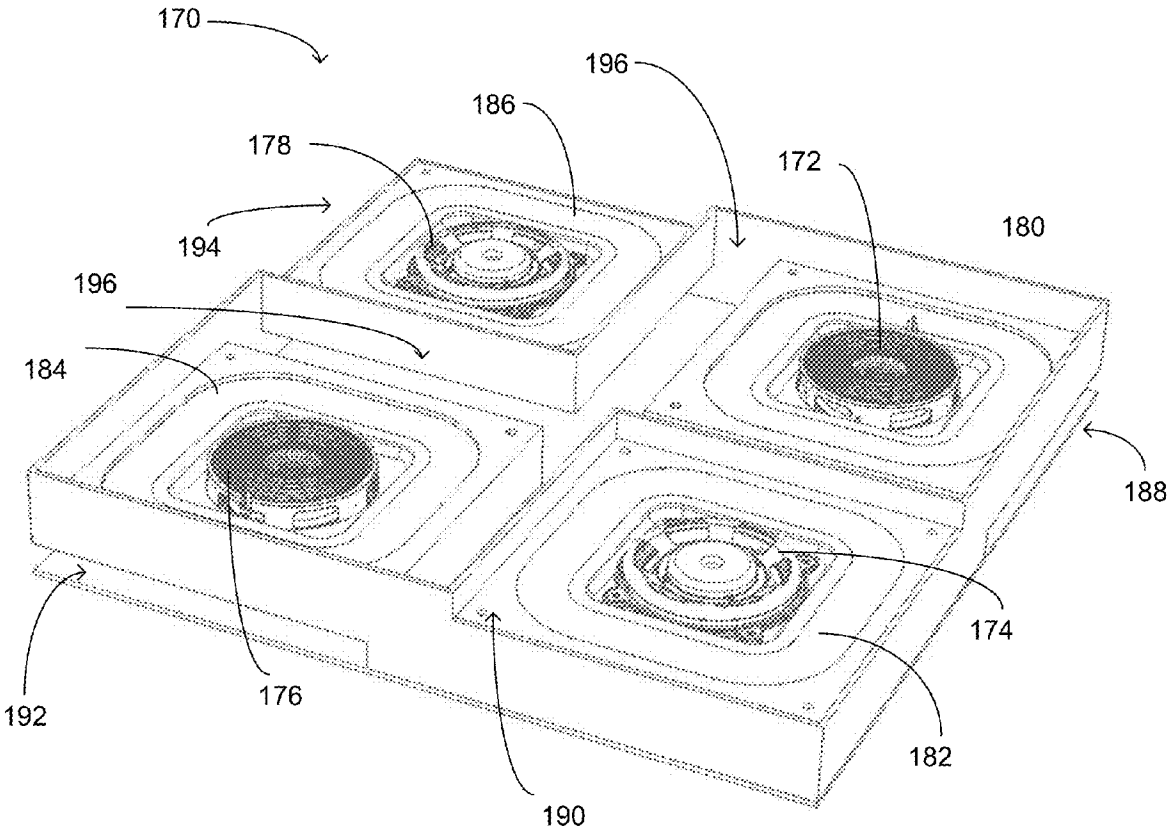
FIG. 10 is a still further example of a speaker as seen from the top, front and left sides.
Figure 11:
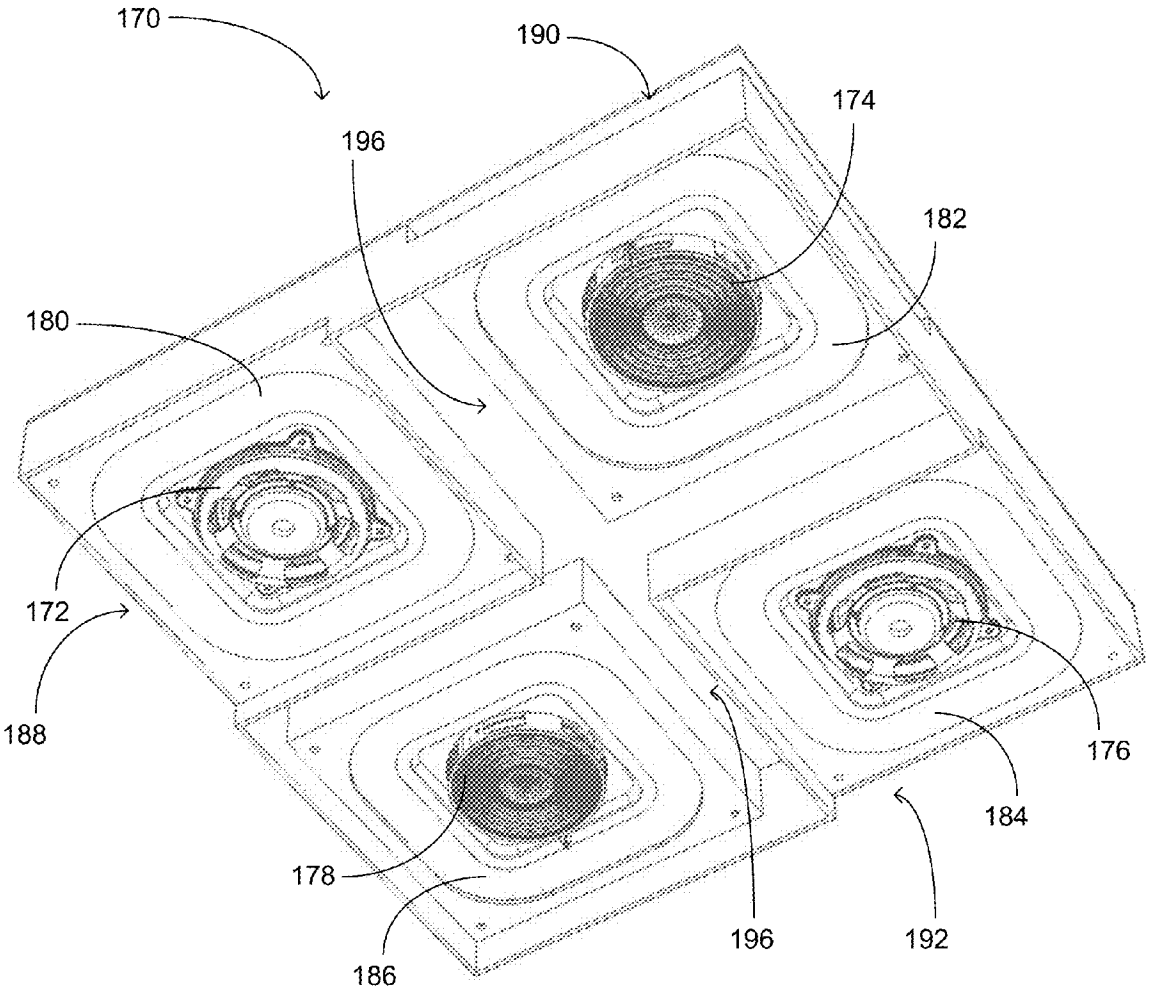
FIG. 11 is a view of the speaker of FIG. 10 as seen from the bottom, rear and right sides.

FIGS. 10 and 11 disclose another example of a speaker 170. Four drivers 172, 174, 176 and 178 are respectively mounted on four passive radiators 180, 182, 184 and 186. The driver/radiator pairs 172/180, 174/182, 176/184 and 178/186 each radiate acoustic energy which exits the speaker through respective openings 188, 190, 192 and 194 in the housing in a manner similar to that described above with reference to FIG. 3. The driver/radiator pairs 172/180, 174/182, 176/184 and 178/186 each also radiate acoustic energy into a common acoustic volume 196 which functions in a similar way to the acoustic volume 76 described above. As such, the driver/radiator pairs 172/180, 174/182, 176/184 and 178/186 each have a surface exposed to the common acoustic volume 196 in a manner similar to that described above with reference to FIG. 3. As in FIG. 3, the driver/radiator pairs 172/180, 174/182, 176/184 and 178/186 do not overlap each other in a direction parallel to a direction of motion of a moving portion of the passive radiators.

It will be understood that additional modifications may be made without departing from the spirit and scope of the examples described herein, and, accordingly, other embodiments are within the scope of the following claims. For example, a speaker can be made that includes a greater even number (e.g. 6, 8) of passive radiators.

What is claimed is:

1. A speaker, comprising:

a housing;

four substantially similar electro-acoustic drivers secured inside the housing and driven by substantially the same audio signal, the drivers being arranged such that the net mechanical vibrational force between the drivers and the housing is substantially zero; and four substantially similar passive radiators secured inside the housing and driven by acoustic energy from the four drivers, the passive radiators being arranged such that the net mechanical vibrational force between the passive radiators and the housing is substantially zero, wherein the intended directions of travel of the four drivers and the four passive radiators are substantially parallel with a shortest dimension of the housing.

2. The speaker of claim 1, wherein the intended directions of travel of the four drivers and the four passive radiators are substantially parallel with each other.

3. The speaker of claim 1, wherein a longest dimension of each of the drivers and each of the passive radiators lies substantially in a common plane.

4. The speaker of claim 1, one of the drivers having a diaphragm with a first surface and a second surface, the diaphragm being vibrated during operation of the driver such that the first surface creates acoustic energy in a first acoustic volume inside the housing, the acoustic energy exiting the speaker through an opening in the housing located along a first portion of the housing.

5. The speaker of claim 4, one of the passive radiators having a first surface and a second surface, the diaphragm being vibrated during operation of the driver such that the second surface of the diaphragm creates acoustic energy in a second acoustic volume inside the housing, the acoustic energy in the second acoustic volume impinging on the first surface of the passive radiator which causes the passive radiator to vibrate, a second surface of the passive radiator thereby creating acoustic energy which exits the speaker through a second opening in the housing located along a second portion of the housing which is oriented at substantially a right angle to the first portion of the housing.

6. The speaker of claim 1, wherein the four drivers are arranged substantially side-by-side with each other in a substantially straight line.

7. The speaker of claim 1, wherein the four passive radiators are arranged substantially side-by-side with each other in a substantially straight line.

8. The speaker of claim 1, wherein each driver is mounted on a respective passive radiator.

9. A speaker, comprising:

a housing;

an electro-acoustic driver secured inside the housing and having a diaphragm with a first surface and a second surface, the diaphragm being vibrated during operation of the driver such that the first surface creates acoustic energy in a first acoustic volume inside the housing, the acoustic energy exiting the speaker through an opening in the housing located along a first portion of the housing; and a passive radiator secured inside the housing and having a first surface and a second surface, the diaphragm being vibrated during operation of the driver such that the second surface of the diaphragm creates acoustic energy in a second acoustic volume inside the housing, the acoustic energy in the second acoustic volume impinging on the first surface of the passive radiator which causes the passive radiator to vibrate, a second surface of the passive radiator thereby creating acoustic energy which exits the speaker through a second opening in the housing located along a second portion of the housing which is oriented at substantially a right angle to the first portion of the housing.

10. The speaker of claim 9, wherein the intended directions of travel of the driver and the passive radiator are substantially parallel with each other.

11. The speaker of claim 9, wherein the intended directions of travel of the driver and the passive radiator are substantially parallel with a shortest dimension of the housing.

12. The speaker of claim 9, wherein a longest dimension of the driver and the passive radiator lies substantially in a common plane.

13. A speaker, comprising:

a housing having a first internal surface and a second internal surface that is substantially parallel with the first surface, the housing defining at least a portion of a common acoustic volume inside the housing; and first and second electro-acoustic drivers secured inside the housing that each have a diaphragm with a first surface and a second surface, the first surface of the first driver facing the first internal surface of the housing, the second surface of the first driver facing the second internal surface of the housing and the common acoustic volume, the first surface of the second driver facing the second internal surface of the housing, the second surface of the second driver facing the first internal surface of the housing and the common acoustic volume, wherein a longest dimension of each of the drivers and each of the passive radiators lies substantially in a common plane.

14. The speaker of claim 13, further including first and second passive radiators secured inside the housing and each having a first surface and a second surface, the first surface of the first passive radiator facing the first internal surface of the housing, the second surface of the first passive radiator facing the second internal surface of the housing and the common acoustic volume, the first surface of the second passive radiator facing the second internal surface of the housing, the second surface of the second passive radiator facing the first internal surface of the housing and the common acoustic volume.

15. The speaker of claim 13, wherein the intended directions of travel of the drivers and the passive radiators are substantially parallel with each other.

16. The speaker of claim 13, wherein the intended directions of travel of the drivers and the passive radiators are substantially parallel with a shortest dimension of the housing.

17. A speaker, comprising:

a housing having a first internal surface and a second internal surface that is substantially parallel with the first surface, the housing defining at least a portion of a common acoustic volume inside the housing; and first and second passive radiators secured inside the housing and each having a first surface and a second surface, the first surface of the first passive radiator facing the first internal surface of the housing, the second surface of the first passive radiator facing the second internal surface of the housing and the common acoustic volume, the first surface of the second passive radiator facing the second internal surface of the housing, the second surface of the second passive radiator facing the first internal surface of the housing and the common acoustic volume, wherein the intended directions of travel of the passive radiators are substantially parallel with a shortest dimension of the housing.

18. The speaker of claim 17, wherein the intended directions of travel of the passive radiators are substantially parallel with each other.

19. The speaker of claim 17, wherein a longest dimension of each of the passive radiators lies substantially in a common plane.

20. The speaker of claim 17, further including an electro-acoustic driver secured inside the housing and having a diaphragm with a first surface and a second surface, the diaphragm being vibrated during operation of the driver such that the first surface creates acoustic energy in an additional acoustic volume inside the housing, the acoustic energy exiting the speaker through an opening in the housing located along a portion of the housing.

* * * * *